US007520236B2

(12) United States Patent
Seipel et al.

(10) Patent No.: US 7,520,236 B2
(45) Date of Patent: Apr. 21, 2009

(54) ELEVATED WATER SPORT TOW EXTENSION APPARATUS

(76) Inventors: Michael Seipel, 3879 N. Richards St., Milwaukee, WI (US) 53212; John Seipel, 3879 N. Richards St., Milwaukee, WI (US) 53212; Deen LaVeil, 3731 NW. 9th Ave., Apt. #3, Pompano Beach, FL (US) 33064-1943

( * ) Notice: Subject to any disclaimer, the term of this patent is extended or adjusted under 35 U.S.C. 154(b) by 34 days.

(21) Appl. No.: 11/753,997

(22) Filed: May 25, 2007

(65) Prior Publication Data

US 2008/0289561 A1 Nov. 27, 2008

(51) Int. Cl.

| | |
|---|---|
| ***B63B 21/04*** | (2006.01) |
| ***B63B 21/56*** | (2006.01) |
| *F15D 1/10* | (2006.01) |
| *B63B 17/00* | (2006.01) |

(52) U.S. Cl. ..... 114/253; 114/242; 114/243; 114/343; 114/364

(58) Field of Classification Search ..... 114/242, 114/243, 253, 343, 364

See application file for complete search history.

(56) References Cited

U.S. PATENT DOCUMENTS

| | | | | |
|---|---|---|---|---|
| 4,213,413 A | | 7/1980 | Courtney | |
| 4,589,366 A | | 5/1986 | Eiber | |
| 5,241,921 A | * | 9/1993 | Sadlak | 114/253 |
| 5,934,217 A | * | 8/1999 | Allsop | 114/242 |
| 5,943,977 A | * | 8/1999 | Womack et al. | 114/242 |
| 5,979,350 A | | 11/1999 | Larson et al. | |
| 6,044,788 A | | 4/2000 | Larson et al. | |
| 6,192,819 B1 | | 2/2001 | Larson et al. | |
| 6,374,762 B1 | | 4/2002 | Larson et al. | |
| RE37,823 E | | 9/2002 | Larson et al. | |
| 6,575,112 B2 | * | 6/2003 | Roeseler et al. | 114/253 |
| 6,666,159 B2 | | 12/2003 | Larson et al. | |
| 6,925,957 B2 | | 8/2005 | Schultz | |
| 7,017,509 B2 | | 3/2006 | Schultz | |

* cited by examiner

*Primary Examiner*—Lars A Olson
*Assistant Examiner*—Daniel V Venne

(57) ABSTRACT

An elevated tow device comprised of: first and second substantially vertical support members, each slidably and pivotally engaging a boat support structure on a lower end and forming an apex on an upper end, the height and width of which can be adjusted; a tether attachment point at the apex adapted to mechanically engage a tether for connecting to a towed object; at least one forestay connecting the device to a bow of the boat; and at least one rear stay connecting the device to the boat support structure, the forestay and rear stay providing stability to the device. Because of the way that the device is connected to the boat support structure, the device is adjustable in height and width and is also collapsible.

19 Claims, 9 Drawing Sheets

ELEVATED WATER SPORT TOW EXTENSION APPARATUS

FIELD OF INVENTION

This invention relates generally to the field of towing units for water sports, and in particular to the field of an adjustable and collapsible device that can be positioned on top of a support structure to elevate a tow rope connection point.

BACKGROUND

Figure 1:
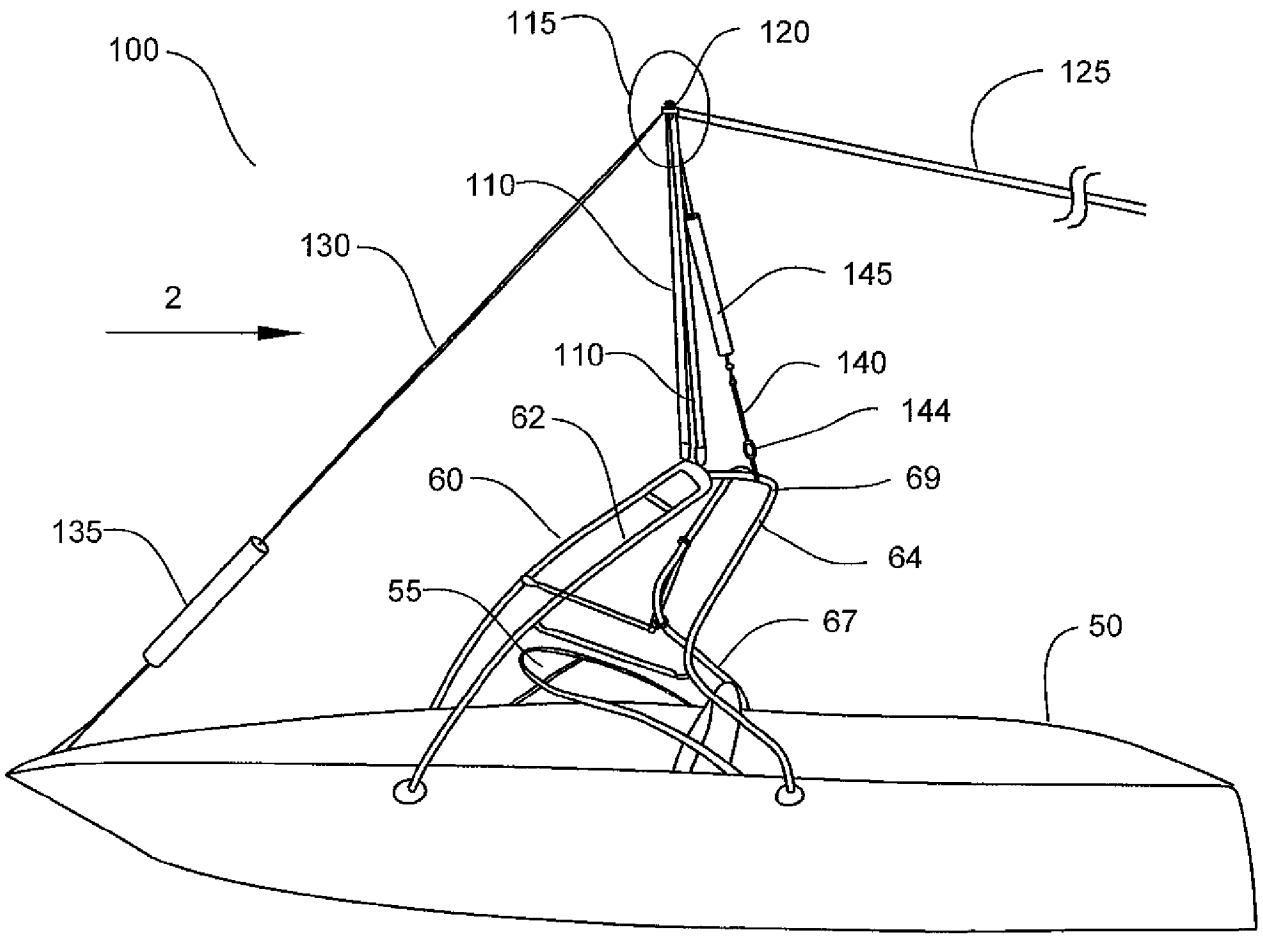
FIG. 1 shows a side perspective view of a boat with one embodiment of the elevated water sport tow extension apparatus positioned thereon, ready for use.

Conventional ski and wakeboard tows are included on virtually all commercially available ski boats. One example of a tow that has been used for many years extends upwardly from the rear of the boat for conventional water ski towing.

However, special purpose ski and wakeboard tow devices which in enhance the performance and ability of wake boarders and skiers to do jumps and stunts are increasingly popular. In particular, a vertical extension can be used to provide a higher towrope attachment tow angle to the tow rope. The higher attachment helps the rider to jump higher and stay in the air longer, thereby facilitating and enhancing the effects of wake jumping while barefoot or using skis, wakeboards, or other water ski devices. However, there are disadvantages of having such an extension due to the fact that the boat may need to be stored in a covered slip or shed where overhead clearance is limited.

As used herein, "support structure" refers to a structure extending upward from the boat, typically over the boat operator's station, that can be of any shape or configuration adapted to support an elevated water sport tow extension apparatus.

As used herein, "stay" refers to a rope or cable used as a brace or support, or a securing device for a mast, spar, or the elevated water sport tow extension apparatus and the like.

As used herein, "forestay" refers to a stay positioned at or toward the forward deck of a boat.

As used herein, "rear stay" refers to a stay positioned at or toward the rearward deck of a boat.

As used herein, a "tether" refers to a rope or cable which is held by a skier, a barefoot skier, or wakeboarder and which may or may not have a handle attached. A tether may further be used to pull inner tubes or any other recreational water devices or functional device used in connection with boating, wakeboarding, or waterskiing activities.

As used herein, "cap" refers to any cover or attachment at the end of a tube, e.g., a U-shaped support.

As used herein, "adjustable" refers to any element capable of being reoriented or changed in length.

As used herein, "apex" refers to not only the uppermost point of the elevated water sport tow extension apparatus, but the entire area at the top of the elevated water sport tow extension apparatus.

As used herein, "towed object" refers to any object, device, or apparatus that can be towed behind a boat, including but not limited to one or more wakeboarding persons, persons on water skis, inner tubes and inner tuber riders, barefoot skiers, and combinations thereof.

DETAILED DESCRIPTION OF EMBODIMENTS OF THE INVENTION

For the purpose of promoting an understanding of the present invention, references are made in the text hereof to embodiments of an elevated water sport tow extension apparatus, only some of which are depicted in the figures. It should nevertheless be understood that no limitations on the scope of the invention are thereby intended. One of ordinary skill in the art will readily appreciate that modifications such as the size and shape of the components, materials from which the components are made, the type of support structure to which the elevated water sport tow extension apparatus is secured, and the inclusion of additional elements are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed system, structure, or manner.

It should be understood that the drawings are not necessarily to scale, emphasis instead being placed upon illustrating the principles of the invention. In addition, in the embodiments depicted herein, like reference numerals refer to like structural elements in the various drawings.

Moreover, the term "substantially" or "approximately" as used herein may be applied to modify any quantitative representation that could permissibly vary without resulting in a change in the basic function to which it is related. For example, one embodiment of an elevated water sport tow extension apparatus is disclosed herein as being positioned substantially vertical relative to the boat. The elevated water sport tow extension apparatus could permissibly be somewhat non-vertical and still be within the scope of the invention if its functionality is not materially altered. Similarly, one alternate embodiment of the elevated water sport tow extension apparatus is disclosed herein as having its tether attachment point at the apex of the elevated water sport tow extension apparatus. The tether attachment point could be some distance below the apex and still be within the scope of the invention if its functionality is not materially altered.

Referring now to the drawings, FIG. 1 shows a side perspective view of boat 50 with one embodiment of the elevated water sport tow extension apparatus 100 positioned thereon, ready for use with a towed object (not shown). As can be seen, boat 50 includes support structure 60 extending upward from boat 50 over boat operator's station 55. Support structure 60 may be of any shape, structure, device, or configuration adapted to support elevated water sport tow extension apparatus 100. In the embodiment shown, support structure 60 includes two (2) U-shaped supports 62, 64 and two (2) horizontal cross bars 67, 69 between U-shaped supports 62, 64 for increased stability. Horizontal cross bars 67, 69 are between the vertical portion of U-shaped supports 62, 64, and horizontal cross bar 69 is between the horizontal portion of U-shaped supports 62, 64 (more clearly visible in FIGS. 2*a* and 2*b*). It should be understood, however, that any number, including zero (0) horizontal cross bars 67, 69 can be positioned between U-shaped supports 62, 64, whether between the horizontal portions of support structure 60 or the horizontal portion connecting the vertical portions.

In the embodiment shown, support structure 60 is made of any material commonly used in the art the provides sufficient stability and corrosion resistance. For example, support structure 60 can be made of stainless steel or aluminum. Furthermore, support structure 60 can be secured to boat 50 by any conventional means commonly employed in the art.

Also visible in the embodiment of elevated water sport tow extension apparatus 100 shown in FIG. 1 are additional features including two (2) substantially vertical support members 110 that meet at apex 115, tether attachment point 120 to which tether 125 attaches to elevated water sport tow extension apparatus 100, also at apex 115, forestay 130, and rear stay 140.

In the embodiment shown, rear stay 140 is connected on a first end to elevated water sport tow extension apparatus 100 at apex 115 and on a second end to rear U-shaped support 64 using carabiner 144. However, other embodiments may use other connecting devices included but not limited to metal loops, cable loops, welded parts, or any other device configured and adapted to connect a stay to a support. Additionally, in an alternate embodiment of elevated water sport tow extension apparatus 100, rear stay 140 can be connected directly to boat 50. Such an embodiment is particularly suited for boats 50 with only one (1) U-shaped support 62. However, if rear stay 140 is connected directly to boat 50, it could interfere with passengers within boat 50. In the embodiment shown, rear stay 140 is made of wire, but can be made of any alternate material that is sufficiently durable and corrosion resistant, including canvas and rope. Excess wire can be bundled up and contained within padding 145, which provides added safety and a more aesthetic appearance. In an alternate embodiment, rear stay 140 includes multiple wires (or canvas, rope, or other material) for greater strength.

Also in the embodiment of elevated water sport tow extension apparatus 100 shown in FIG. 1 is forestay 130 which is connected on a first end to elevated water sport tow extension apparatus 100 at apex 115 and on a second end directly to the bow of boat 50 by a strap that passes around the bow. In alternate embodiments of forestay 130, forestay can be connected to the bow by any means commonly known in the art, including a bowsprit or other spar protruding from the bow or a carabiner to an eye hook positioned on the bow, just to name two (2) examples. As with rear stay 140, forestay 130 is made of wire, but can be made of any alternate material that is sufficiently durable and corrosion resistant, including canvas and rope. Also as with rear stay 140, forestay 130 can include multiple wires (or canvas, rope, or other materials) for additional strength and/or padding 135 to conceal and store any excess wire (or canvas, rope, or other material).

Figure 2A:
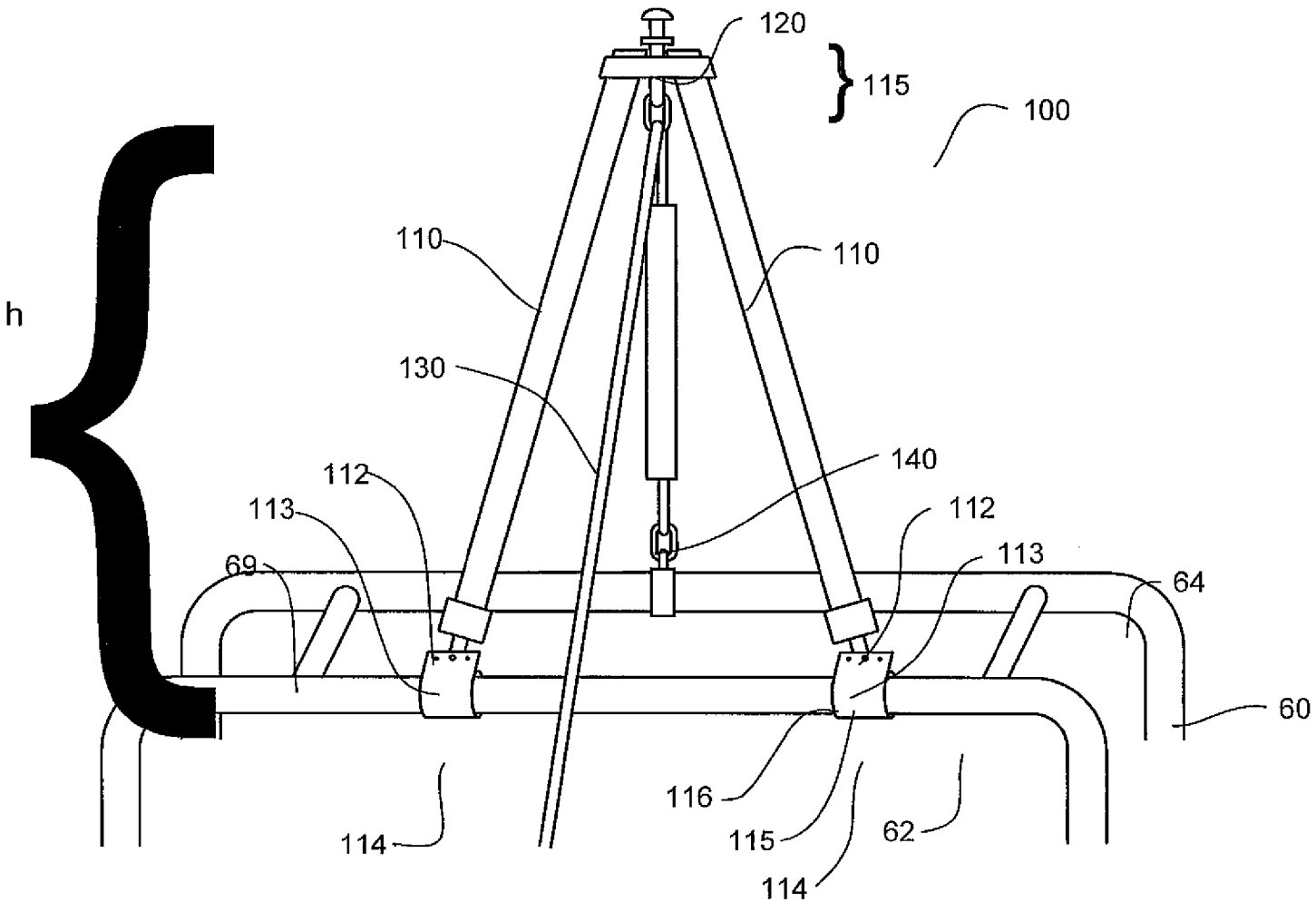
FIGS. 2*a* and 2*b* show front views of the embodiment of the elevated water sport tow extension apparatus shown in FIG. 1, taken along arrow 2, in two adjustable positions to accommodate varying boat widths and support structure configurations.
Figure 2B:
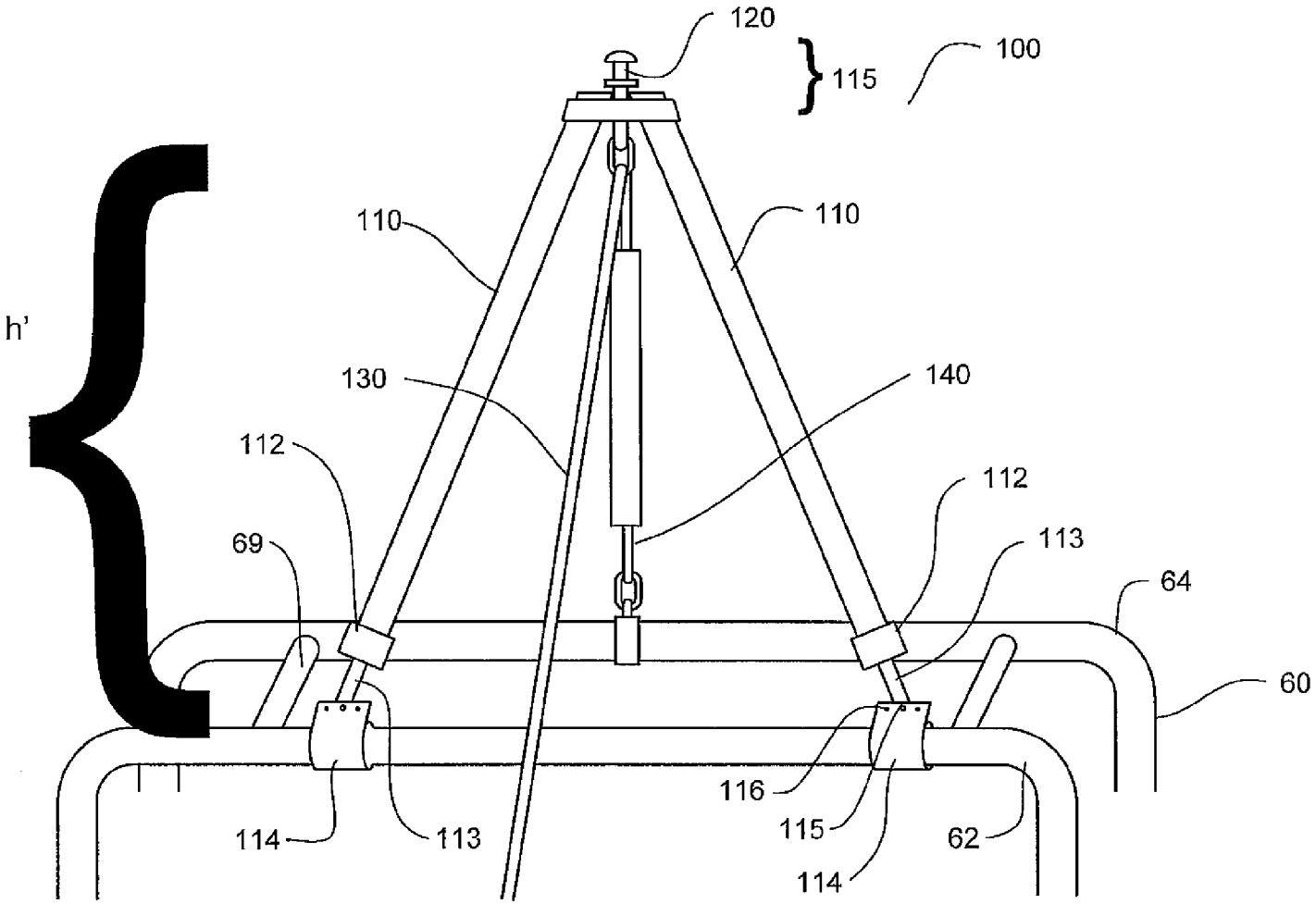

FIGS. 2*a* and 2*b* show front views of the embodiment of the elevated water sport tow extension apparatus shown in FIG. 1, taken along arrow 2, positioned at different angels to accommodate different boat widths and support structure configurations. Referring specifically to FIG. 2*a*, vertical support members 110 meeting at apex 115, tether attachment point 120, forestay 130, and rear stay 140 of elevated water sport tow extension apparatus 100, mounted to support structure can all be appreciated. In the embodiment shown, elevated water sport tow extension apparatus 100 is approximately six feet (6') tall, but elevated water sport tow extension apparatus 100 can be constructed to be any height. A typical height of elevated water sport tow extension apparatus 100 is between approximately 3 feet (3') and nine feet (9') tall.

Vertical support members 110 can be solid or hollow tubes made of any sufficiently durable and corrosion resistant material. In the embodiment shown, vertical support members 110 are each hollow and made of type 304 stainless steel. In addition, vertical support members 110 can be painted or colored to any aesthetically pleasing color. In the embodiment shown, at the bottom end of each vertical support members 110 is cap 112 made of plastic. However, other embodiments may include a cap made from another material, include a component shaped differently, or omit cap 112 entirely. In such an embodiment, vertical support members 110 would then pivotally connect directly to cylinder 114 (as described in detail infra). In the embodiment shown, pivot member 113 extends from cap 112. Pivot member is connected to cylinder 114 by bolt 115. This allows vertical support member 110 to be pivotally connected to cylinder 114, allowing vertical support member 110 to move relative to cylinder 114 leftward and rightward (from this perspective). In addition, cylinder 114 is a plastic hollow tube secured to forward U-shaped support 62 by tightening bolts 116. By loosening bolts 116, the diameter of cylinder 114 is increased, allowing cylinder 114 to be moved along forward U-shaped support 62 as well as rotated forward and rearward. This combination of elements at the point where vertical support member 110 mechanically engages forward U-shaped support 62 allows the position of vertical support member 110 to move inward, outward, forward, and rearward. Thus, when bolts 116 are loosened, cylinders 114 can be moved inward along forward U-shaped support 62 (and rotated forward or rearward if necessary) or outward along U-shaped support 62 as shown in FIG. 2*b*. This allows height h of elevated water sport tow extension apparatus 100 to be changed from h of FIG. 2*a* to *h*' of FIG. 2*b* as needed as well as allow the positions of vertical support members 110 to be changed to accommodate various support structures 60 and avoid any canopy, speakers, lights, ski racks, and/or wakeboard racks (not shown) that may be present on support structure 60.

Figure 3:
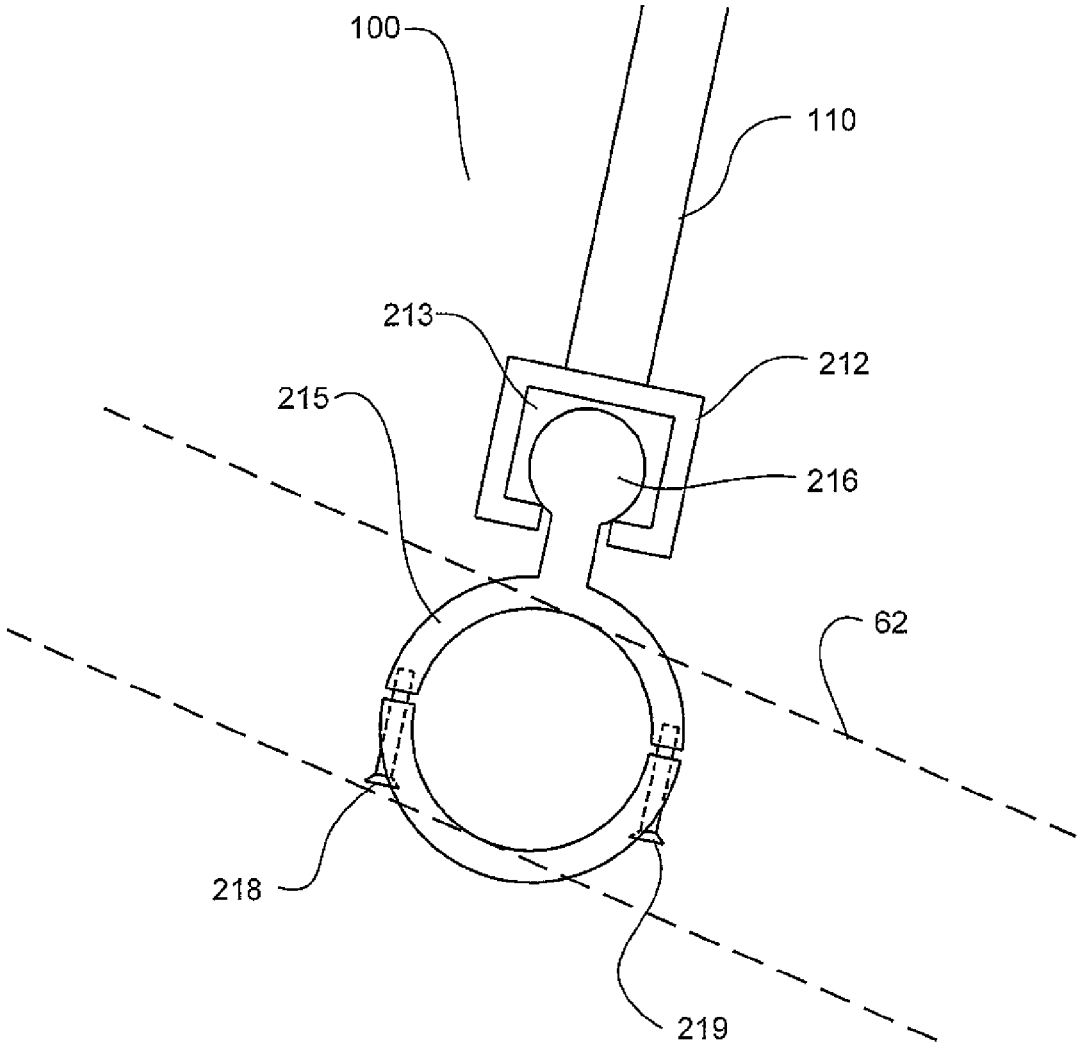
FIG. 3 shows a cross-sectional view of one alternate embodiment of the mechanical connection between the elevated water sport tow extension apparatus and the support structure.

FIG. 3 shows a cross-sectional view of one alternate embodiment of the mechanical connection between elevated water sport tow extension apparatus 100 and a support structure. Specifically, FIG. 3 shows one (1) vertical support member 110 and U-shaped support 62 (shown in broken lines) of the support structure in which ball joint 215 is used to pivotally and slidably connect one (1) vertical support member 110 to U-shaped support 62. A second ball joint (not shown) is used to similarly connect the second vertical support member (also not shown) to U-shaped support 62. In this embodiment of elevated water sport tow extension apparatus 100, vertical support member 110 includes cap 212 at the lowermost end of vertical support member 110, and ball joint 215 is comprised of two (2) halves that can be secured to each other with two (2)

screws 218, 219 to form aperture 217. The upper portion of ball joint 215 is further comprised of ball 216 which fits within recess 213 within cap 212. U-shaped support 62 fits within aperture 217. Such a construction allows ball joint 215 to rotate forward, backward, rightward, and leftward, as well as spin, allowing ball joint 215 and vertical support member 110 to mechanically engage U-shaped support 62 at any point. Specifically, ball joint 215 can engage U-shaped support 62 along its horizontal portion (as elevated water sport tow extension apparatus 100 engages support structure 60 in FIGS. 2*a* and 2*b*) or along the downward portion of U-shaped support 62 (as can be seen in FIG. 1). This allows elevated water sport tow extension apparatus 100 to be adaptable to a greater variety of types and styles of support structures while maintaining the collapsible feature.

Figure 4:
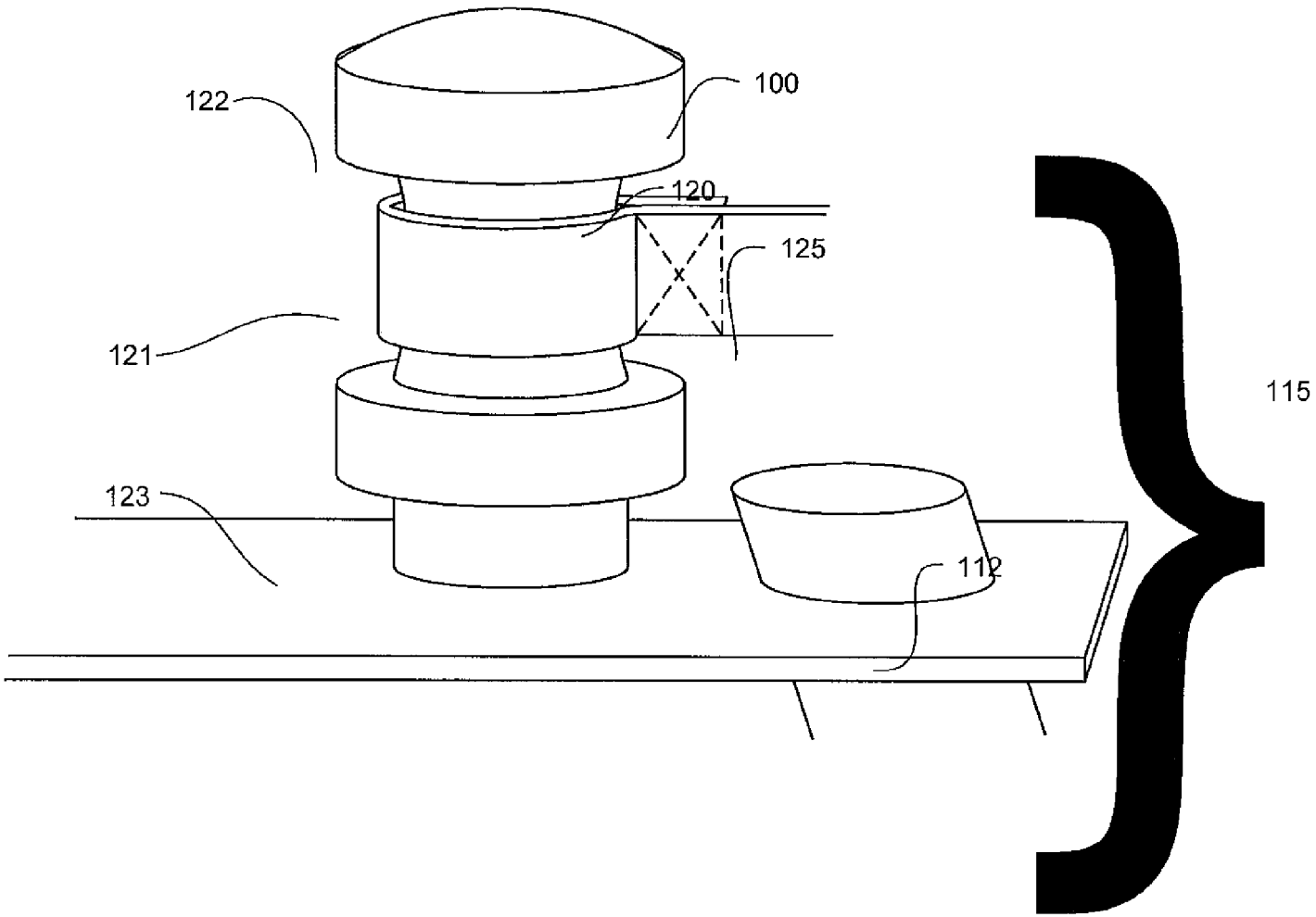
FIG. 4 shows a top perspective view of a portion of one embodiment of a tether attachment point.

Referring again to FIGS. 2*a* and 2*b*, also visible is tether attachment point 120, as shown enlarged in FIG. 4, which is a top perspective view of one embodiment of tether attachment point 120. Tether attachment point 120 is positioned at apex 115 to provide a point at which tether 125 can engage elevated water sport tow extension apparatus. Tether attachment point 120 is comprised of top stop 122, bottom stop 123, and neck 121. In the embodiment shown, tether 125 is sewn in to a loop and positioned around neck 121. Top stop 122 and bottom stop 123 prevent tether 125 from sliding off of tether attachment point 120. In the embodiment shown, tether attachment point 120 is made of Delron™ plastic with a urethane coating, but can be made of any alternate sufficiently durable and corrosion resistant material that allows smooth movement of tether 125. Tether 125 can similarly be of any type or material commonly known and used in the art such as canvas, cotton or nylon rope, and the like.

Figure 5:
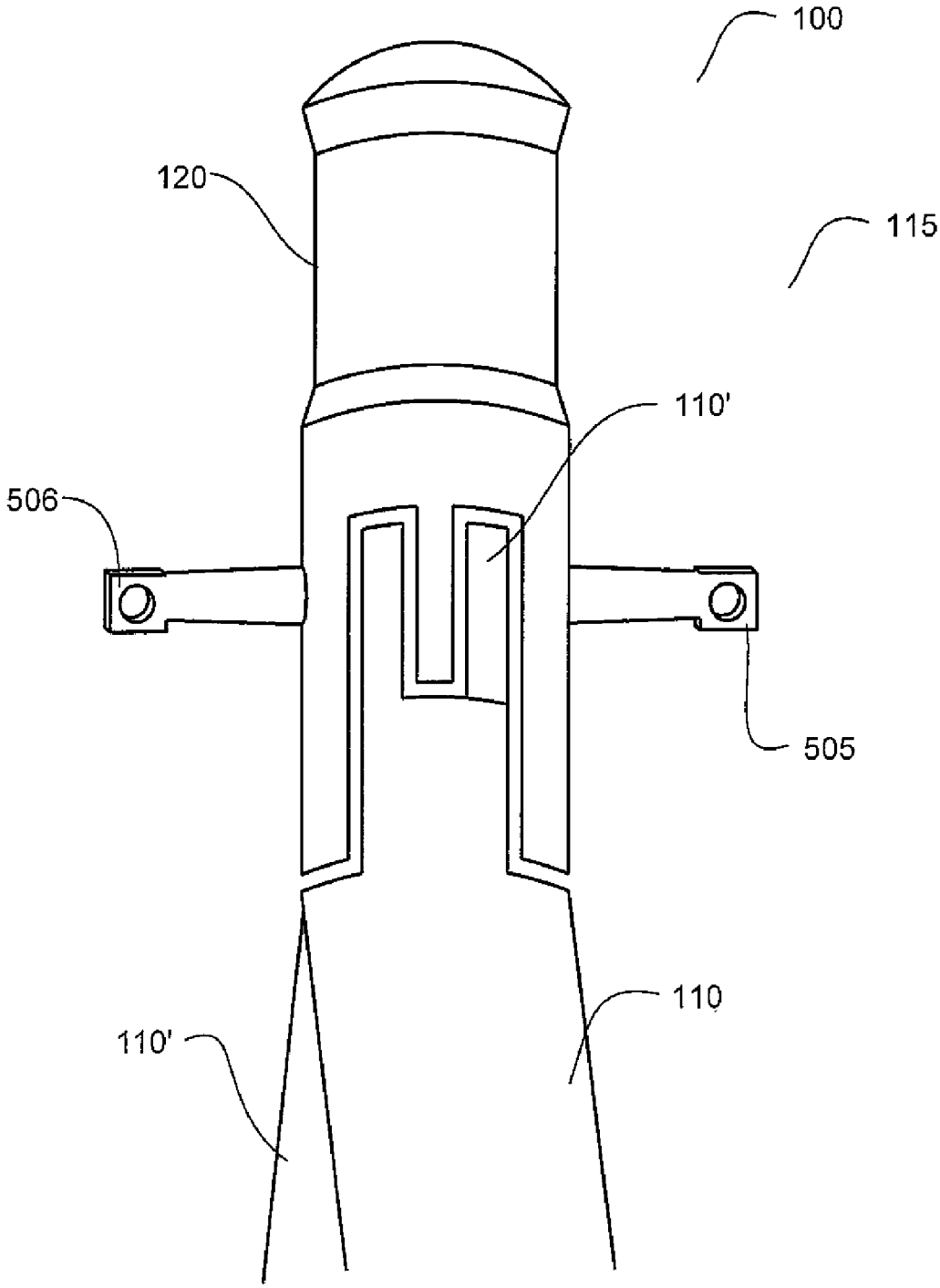
FIG. 5 shows a front view of an alternate embodiment of a tether attachment point.

FIG. 5 shows a front view of an alternate embodiment of a tether attachment point 120. In the embodiment shown, two (2) support members 110, 110' meet at apex 115 and tether attachment point 120, to which the tether (not shown) attaches to elevated water sport tow extension apparatus 100, can all be appreciated. Also visible are connection points 505, 506 to which the rear stay (also not shown) and the forestay (also not shown) attach respectively. In the embodiment shown, support members 110, 110' pivotally meet at apex 115 and connect to each other and apex 115, allowing support members 110, 110' to adjustably attach to the support structure (also not shown).

Figure 6:
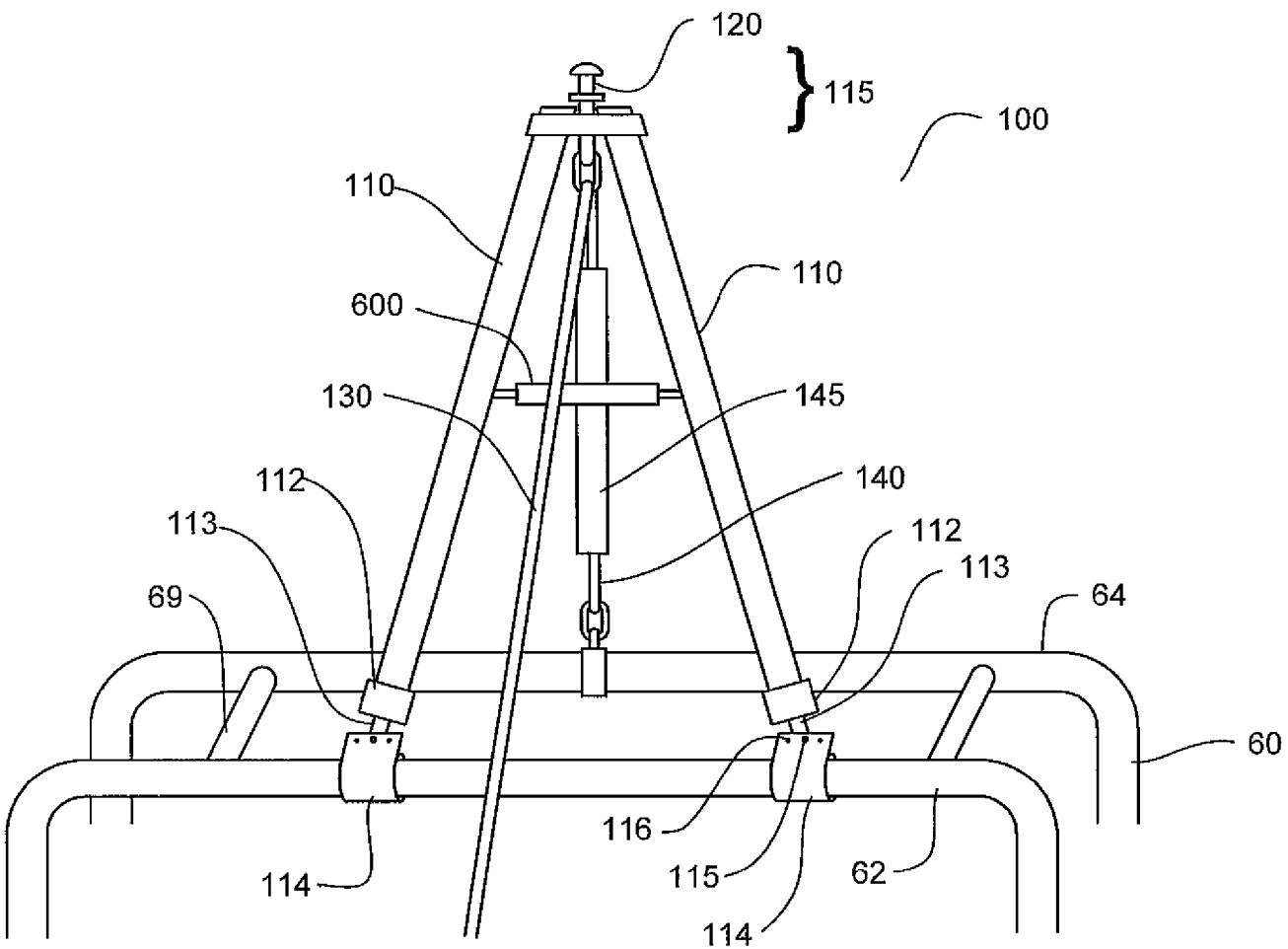
FIG. 6 shows an alternate embodiment of the elevated water sport tow extension apparatus including a turnbuckle.

FIG. 6 shows an alternate embodiment of elevated water sport tow extension apparatus 100 including turnbuckle 600. Turnbuckle 600 is positioned between support members 110. One (1) side of turnbuckle 600 has right-twisting threads and the other side of turnbuckle 600 has left-twisting threads such that when turnbuckle 600 is rotated, support members 110 move inward or outward. Turnbuckle 600 thus helps adjust the positioning of support members 110, allowing for the adjustability and collapsibility of elevated water sport tow extension apparatus 100, while adding structural support to elevated water sport tow extension apparatus 100.

Figure 7:
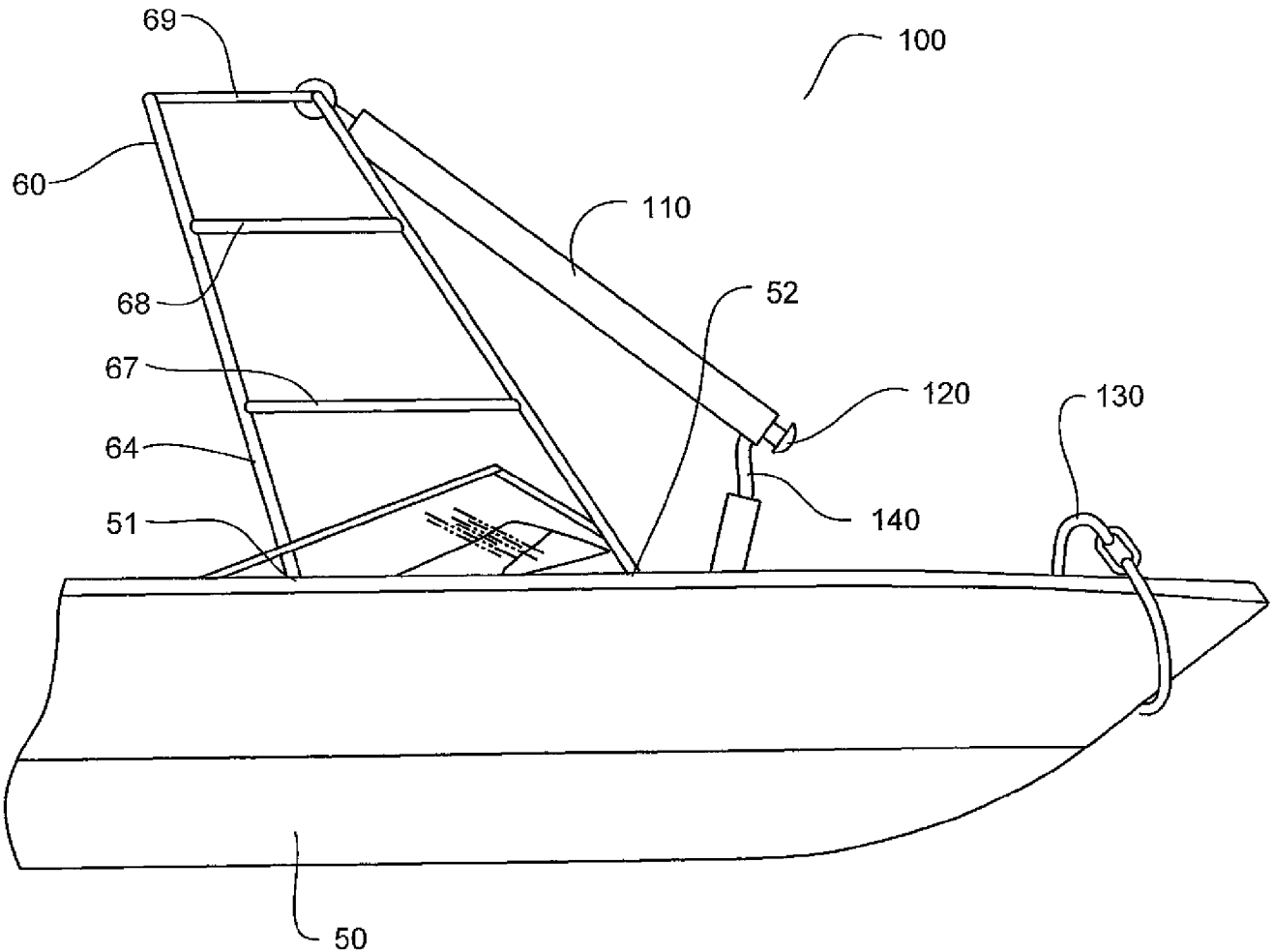
FIG. 7 shows a side perspective view of the forward portion of a boat with one embodiment of the elevated water sport tow extension apparatus positioned thereon, but in a collapsed position.

FIG. 7 shows a side perspective view of the forward portion of boat 50 with one embodiment of elevated water sport tow extension apparatus 100 positioned thereon, but in a collapsed position. By unhooking the carabiner (not shown; visible in FIG. 1) that secures rear stay 140 to rear U-shaped support 64, elevated water sport tow extension apparatus 100 can be pivoted forward around forward U-shaped support 62 to reduce the overall profile of boat 50 for storage, when passing under a bridge, or any other reason as use may require. Forestay 30 has also been disconnected from elevated water sport tow extension apparatus 100. Similarly, elevated water sport tow extension apparatus 100 can be pivoted rearward around forward U-shaped support 62.

In addition, in some boats 50, support structure 60 can be disengaged from boat 50. For example, support structure 60 engages boat 50 at connection points 51, 52. By disconnecting connection point 51 and pivoting support structure at connection point 52, support structure 60 and elevated water sport tow extension apparatus 100 can be rotated to the forward portion of boat 50, thereby further reducing the profile of boat 50.

Figure 8:
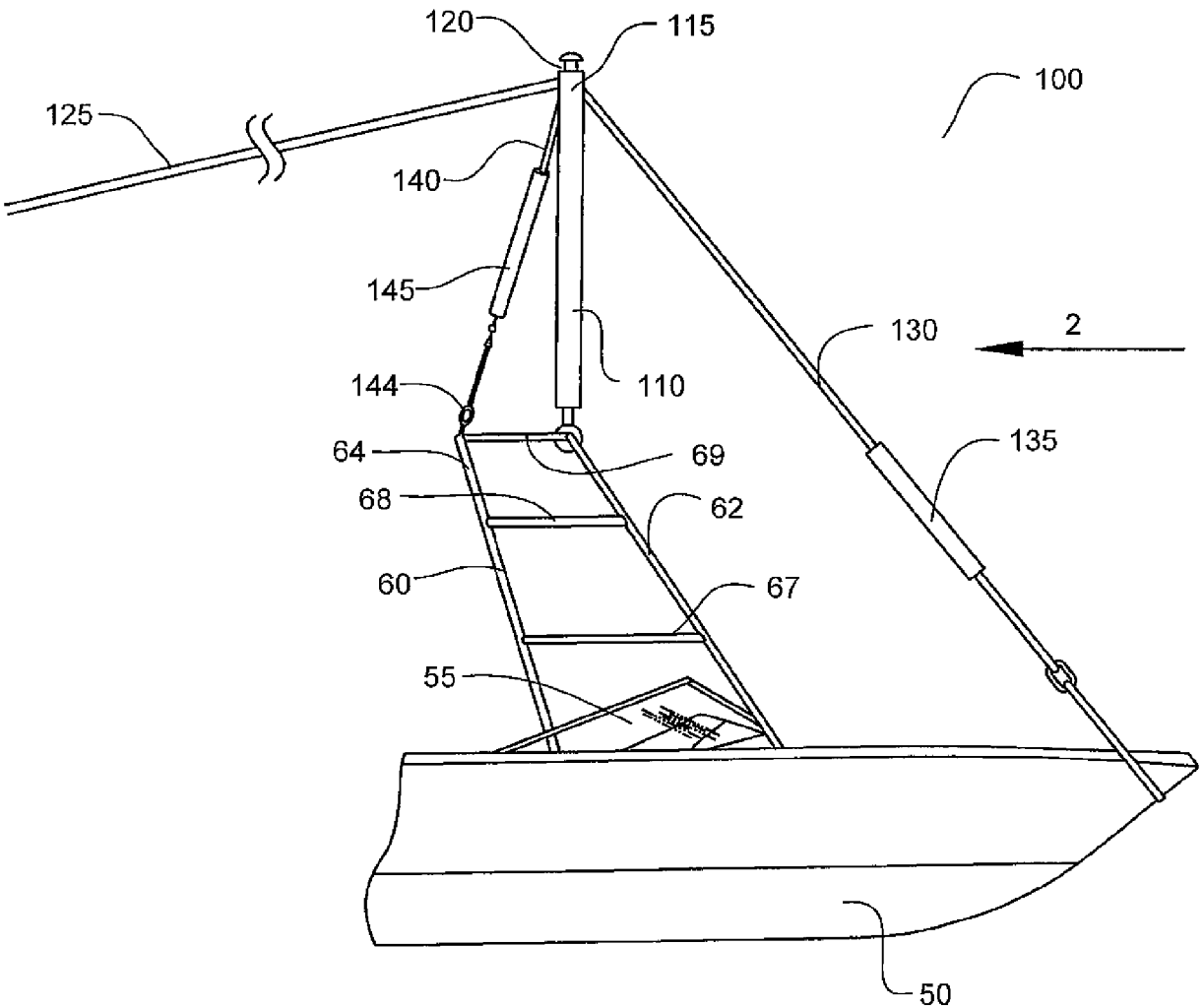
FIG. 8 shows a side view of the forward portion of a boat with the elevated water sport tow extension apparatus in use with a different type of support of support structure.

FIG. 8 shows a side view of the forward portion of a boat with elevated water sport tow extension apparatus 100 in use with a different type of support structure 60 in which boat 50, operator's station 55, support structure 60, U-shaped supports 62, 64, three (3) horizontal cross bars 67, 68, 69, vertical support member 110, apex 115, tether attachment point 120, tether 125 attached to elevated water sport tow extension apparatus 100 at apex 115, forestay 130, rear stay 140, carabiner 144 and adjustable cable systems 135, 145 can all be seen. As can be appreciated, elevated water sport tow extension apparatus 100 is adaptable to work in conjunction with alternate sizes and shapes of support structure 60. In addition, elevated water sport tow extension apparatus 100 works the same way as previously detailed to allow elevated water sport tow extension apparatus 100 to be both adjustable and collapsible.

While the elevated water sport tow extension apparatus has been shown and described with respect to several embodiments and uses in accordance with the present invention, it is to be understood that the same is not limited thereto, but is susceptible to numerous changes and modifications as known to a person of ordinary skill in the art, and it is intended that the present invention not be limited to the details shown and described herein, but rather cover all such changes and modifications obvious to one of ordinary skill in the art.

What is claimed is:

1. A device comprised of:

a first substantially vertical support member, said first substantially vertical support member having a proximate end and a distal end, said proximate end of said first substantially vertical support member slidably and pivotally engaging a support structure of a boat;

a second substantially vertical support member, said second substantially vertical support member having a proximate end and a distal end, said proximate end of said second substantially vertical support member slidably and pivotally engaging said support structure of said boat;

wherein said distal end of said first substantially vertical support member and said distal end of said second substantially vertical support member slidably and pivotally meet at an apex, a height of said apex and a width of said device being adjustable;

a tether attachment point at said apex, said tether attachment point adapted to mechanically engage a tether for connecting a towed object to said device;

at least one forestay, said at least one forestay mechanically connecting said device to a bow of a boat; and at least one rear stay, said at least one rear stay mechanically connecting said device to said support structure of said boat.

2. The device of claim 1, wherein said first substantially vertical support member and said second substantially vertical support member are made of a material selected from a group comprised of type 304 stainless steel.

3. The device of claim 1, wherein said first substantially vertical support member and said second substantially vertical support member each further include a cap at said proximate end and a pivot member extending from said cap, said pivot member connected to a hollow cylinder, each of said hollow cylinder slidably secured to said support structure.

4. The device of claim 1, wherein said tether attachment point is comprised of a top stop, a bottom stop, and a neck, wherein said tether circumscribes said neck and said top stop and said bottom stop prevent said tether from disengaging said tether attachment point.

5. The device of claim 1, wherein said rear stay and said forestay are made of a material selected from a group comprised of wire, canvas, and rope.

6. The device of claim 1, wherein said rear stay is connected to said support structure by a carabiner.

7. The device of claim 1, wherein said forestay is connected to a bow of said boat by a loop.

8. The device of claim 1, wherein said rear stay and said forestay each further include a adjustable cable system.

9. The device of claim 1, wherein said towed object is selected from a group comprised of one or more water skis and water skiers, one or more wakeboards and wakeboarders, one or more inner tubes and inner tube riders, one or more barefoot skiers, and combinations thereof.

10. The device of claim 1, wherein said device further includes a turnbuckle positioned between said first substantially vertical support member and said second substantially vertical support member.

11. An elevated tow device comprised of:

a first substantially vertical support member, said first substantially vertical support member having a proximate end and a distal end, said proximate end of said first substantially vertical support member slidably and pivotally engaging a support structure of a boat;

a second substantially vertical support member, said second substantially vertical support member having a proximate end and a distal end, said proximate end of said second substantially vertical support member slidably and pivotally engaging said support structure of said boat;

wherein said distal end of said first substantially vertical support member and said distal end of said second substantially vertical support member slidably and pivotally meet at an apex;

a tether attachment point at said apex, said tether attachment point adapted to mechanically engage a tether for connecting a towed object to said device;

at least one adjustable forestay, said at least one forestay mechanically connecting said device to a bow of a boat to stabilize said device;

a first adjustable cable system positioned on said at least one adjustable forestay;

at least one adjustable rear stay, said at least one rear stay mechanically connecting said device to said support structure of said boat to stabilize said device; and a second adjustable cable system positioned on said at least one adjustable rear stay;

wherein a height of said apex and a width of said device are adjustable.

12. The device of claim 11, wherein said first substantially vertical support member and said second substantially vertical support member are made of a material selected from a group comprised of type 304 stainless steel.

13. The device of claim 11, wherein said first substantially vertical support member and said second substantially vertical support member each further include a cap at said proximate end and a pivot member extending from said cap, said pivot member connected to a hollow cylinder, each of said hollow cylinder slidably secured to said support structure.

14. The device of claim 11, wherein said tether attachment point is comprised of a top stop, a bottom stop, and a neck, wherein said tether circumscribes said neck and said top stop and said bottom stop prevent said tether from disengaging said tether attachment point.

15. The device of claim 11, wherein said rear stay and said forestay are made of a material selected from a group comprised of wire, canvas, and rope.

16. The device of claim 11, wherein said rear stay is connected to said support structure by a carabiner.

17. The device of claim 11, wherein said forestay is connected to a bow of said boat by a loop.

18. The device of claim 11, wherein said towed object is selected from a group comprised of one or more water skis and water skiers, one or more wakeboards and wakeboarders, one or more inner tubes and inner tube riders, one or more barefoot skiers, and combinations thereof.

19. The device of claim 11, wherein said device further includes a turnbuckle positioned between said first substantially vertical support member and said second substantially vertical support member.

* * * * *